US005576682A

United States Patent [19]

Fisher et al.

[11] Patent Number: 5,576,682

[45] Date of Patent: Nov. 19, 1996

[54] FUSE HOLDER AND METHOD FOR ASSEMBLING

[75] Inventors: John L. Fisher, Lexington; J. Donald Richerson, Versailles; Ronald F. Dornbrock, Versailles; John E. Cloyd, Versailles; Stephen D. Smith, Lawrenceburg, all of Ky.

[73] Assignee: Kuhlman Electric Corporation, Versailles, Ky.

[21] Appl. No.: 210,838

[22] Filed: Mar. 21, 1994

[51] Int. Cl.[6] ..... H01H 85/02; H01H 85/50

[52] U.S. Cl. ..... 337/186; 337/201; 337/204; 337/205; 337/213

[58] Field of Search ..... 337/201, 204, 337/205, 213, 186, 187

[56] References Cited

U.S. PATENT DOCUMENTS

| | | | |
|---|---|---|---|
| 3,628,092 | 12/1971 | Keto | 337/186 |
| 3,699,490 | 10/1972 | Macemon | 337/205 |
| 3,775,207 | 11/1973 | Harmon | 156/173 |
| 3,827,011 | 7/1974 | Braunstein | 337/204 |
| 3,829,810 | 8/1974 | Giegerich | 337/205 |
| 4,044,326 | 8/1977 | Rodrigues . | |
| 4,081,778 | 3/1978 | Sack | 337/186 |
| 4,321,576 | 3/1982 | Lien | 337/202 |

OTHER PUBLICATIONS

Photographs and photocopies of photographs of ABB Fuse Holder, I.D. 455B726G02, made by ABB Power T&D Company, Inc., (Asea Brown Boveri) Bluebell, PA. 19422.

Photographs, photocopies of photographs and product literature dated Nov., 1982 for McGraw–Edison Power Systems Division Fusing Apparatus OEM 300–58.

Photographs, photocopies of photographs and 2 pages of product description of General Electric Submersible Dry-Well Fuseholder dated Jun. 1980.

Produce literature and assembly drawing of Current Limiting Fuse Holder Dated Aug. 1981.

*Primary Examiner*—Leo P. Picard
*Assistant Examiner*—Stephen T. Ryan
*Attorney, Agent, or Firm*—Townsend and Townsend and Crew LLP

[57] ABSTRACT

A fuse holder (2) for use in electrical apparatus includes a tubular body (6) having outer and inner ends (10, 16). A first electrical contact element (22) and a mounting flange (8) are secured to the inner and outer ends, preferably using resilient retaining rings (53, 68) engaging circular grooves (52, 20; 62, 20) formed in the opposed surfaces. A tubular second electrical contact element (32) is secured within the tubular body and preferably has a flexible electrical terminal strap (24) which extends out through an opening (23) formed in the tubular body. Fluid-tight seals are provided between the inner surface (14) of the tubular body and the outer surfaces (46, 58, 30) of the first and second electrical contact elements and the mounting flange assembly by using pairs of O-rings (38, 50 and 70); an adhesive (39) is also used to secure these elements to the body.

19 Claims, 2 Drawing Sheets

FUSE HOLDER AND METHOD FOR ASSEMBLING

BACKGROUND OF THE INVENTION

Electrical equipment, as well as the primary feed circuits to which the electrical equipment is connected, is protected against excessively high fault currents by use of current limiting fuses. One type of such fuse is housed within a fuse holder designed specially for electrical equipment such as transformers and primary switch/fuse modules serving pad mounted and underground service applications. This type of fuse holder is an externally operated design which accommodates the small space typically available with pad mounted and underground equipment. The current limiting fuses often used with these fuse holders are very sensitive to oil and moisture leaks. Fuse holders are subjected to hot transformer oil immersion within the transformer or switch and to ambient weather conditions outside the transformer or switch. A fuse holder which does not provide good hermetic seals can cause the top closure or cap of the fuse holder to be expulsed quite rapidly due to the creation of gases within the fuse holder when the fuse operates.

Conventional fuse holders include wet wound type fuse holders, such as those made by Kuhlman Electric Corporation of Versailles, Ky. and by the General Electric Company of Hickory, N.C. Construction of these fuse holders include a first contact at the distal or inner end of the fuse holder, a second contact spaced axially along the length of the fuse holder and a mounting flange at the proximal or outer end of the fuse holder. The main body of the tube is made by wet winding resin-impregnated fibers around a mandrel, the electrical contacts and the mounting flange.

Another type of use holder uses a preformed composite tube to which the mounting flange and electrical contacts are mounted. One such fuse holder is made by Cooper Power Systems of Pittsburgh, Pa. This fuse holder has the first electrical terminal threadably mounted to the distal end of the tube and the mounting flange threadably mounted to the proximal end of the tube. The second electrical contact is centrally located along the tube and is of a split-ring design which can partially collapse on itself. The second electrical contact has an outwardly extending boss which passes through an opening in the tube. Once the boss is properly positioned, the split ring expands to its full circular shape to serve as the second electrical terminal within the tube.

SUMMARY OF THE INVENTION

The present invention is directed to a current limiting fuse holder used for electrical apparatus, such as distribution transformers, which is relatively simple in construction, easy to assemble, strong and yet provides the necessary high reliability hermetic seal needed.

The fuse holder includes a tubular body having outer or proximal and inner or distal ends. A first electrical contact element is secured to the inner end, preferably by a resilient retaining ring engaging circular grooves formed in the opposed surfaces of the first electrical contact element and the inner surface of the tubular body. A second electrical contact element is secured within the tubular body at a chosen position. The second electrical contact element is preferably a circular tubular member having a flexible contact strap extending from its outer surface and passing through an opening in the tubular body. A mounting flange assembly is secured to the outer end of the body, also using a resilient retaining ring. Fluid-tight seals are provided between the tubular body and the outer surfaces of the first electrical contact element, the second electrical contact element and the mounting flange assembly, preferably using pairs of O-rings. An adhesive can also be used between the outer surfaces of these elements and the inner surface of the body to keep the elements from rotating within the body.

One of the primary advantages of the invention is that it is less complicated to manufacture than conventional fuse holders and can be manufactured at a lower cost with very high quality. Another advantage of the invention over wet-wound fuse holders is that damaged or improperly assembled fuse holders can be disassembled and the components, with the exception of the tube, reused. This is not generally practical with wet-wound fuse holders because of the difficulty of removing the resin from the components. A further advantage of the invention is the elimination of the need to support wet winding manufacturing techniques, such as specialized ventilation needs and specialized training in wet winding manufacturing.

Other features and advantages of the invention will appear from the following description in which the preferred embodiment has been described in detail in conjunction with the accompanying drawings.

DESCRIPTION OF THE PREFERRED EMBODIMENT

Figure 1:
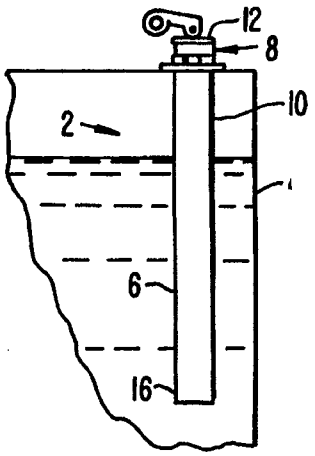
FIG. 1 is a simplified side view showing a fuse holder made according to the invention mounted to the tank of a distribution transformer shown with a top closure sealing the outer end of the fuse holder.

FIG. 1 illustrates a fuse holder 2 mounted to the tank 4 of a distribution transformer. Fuse holder 2 has a tubular body 6 to which a flange assembly 8 is mounted to the outer end 10 of tubular body 6. Flange assembly 8, and thus outer end 10, is closed or sealed by a conventional top closure 12.

Figure 2:
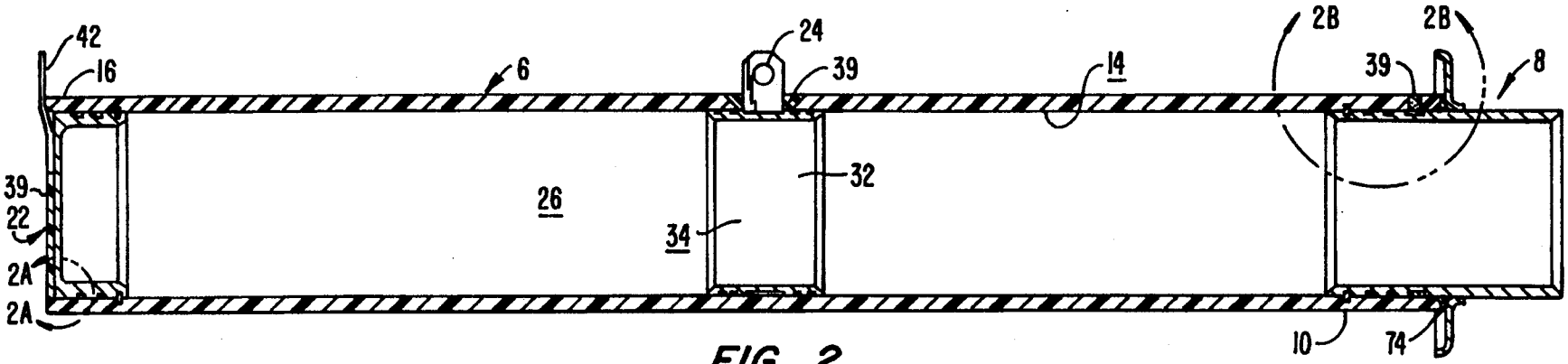
FIG. 2 is a side cross-sectional view of the fuse holder of FIG. 1.
Figure 2A:
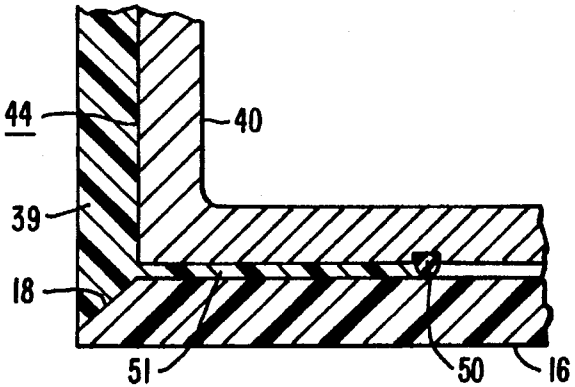
FIGS. 2A and 2B are enlarged views taken along lines 2A—2A and 2B—2B of FIG. 2.
Figure 2B:
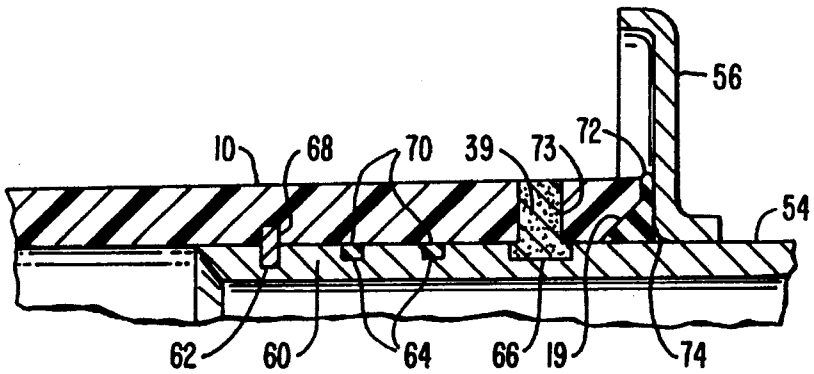
Figure 3:
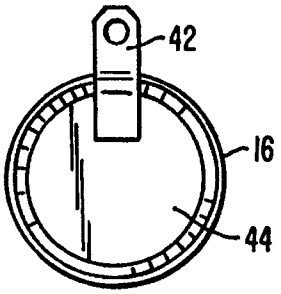
FIG. 3 is an end view of the fuse holder of FIG. 2.
Figure 4:
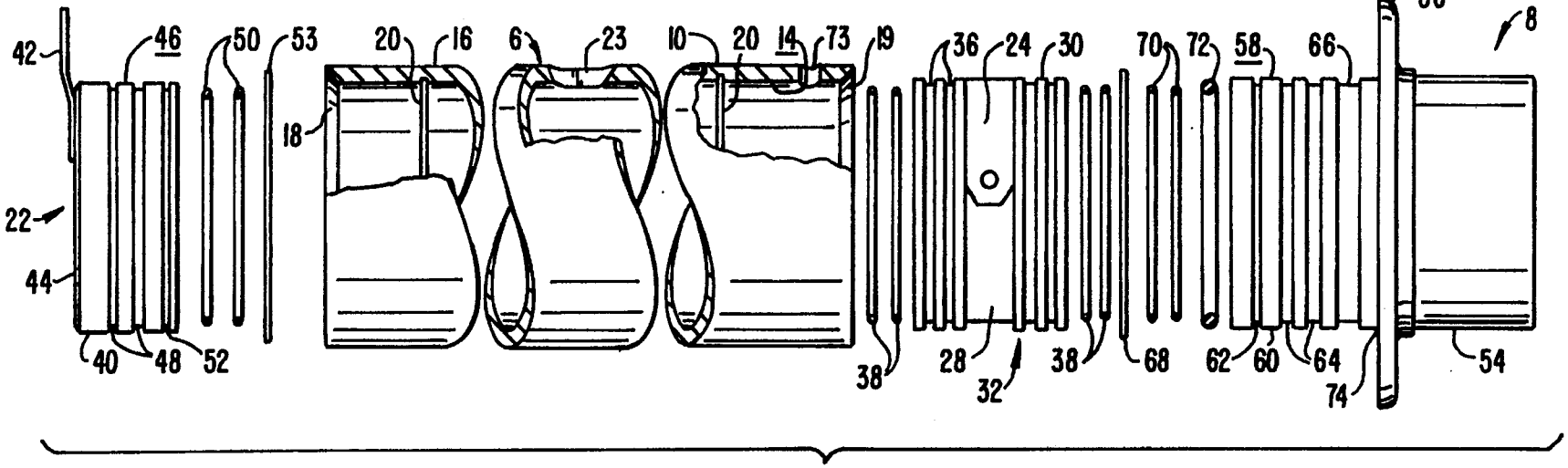
FIG. 4 is an exploded side view, with portions of the tubular body broken away, of the fuse holder of FIG. 2 showing all elements except for the adhesive layers.

Referring also to FIGS. 2–4, tubular body 6 has an epoxy/fiberglass filament wound tubing, such as that made by Janco of Mishawakan, Ind., or Polygon Company of Walkerton, Ind. Tubular body 6 has a relatively smooth, circular cylindrical inner surface 14. Each of the inner (distal) and outer (proximal) ends 16, 10 of tubular body 6 has a chamfered edge 18, 19, respectively. A circumferential groove 20 is formed in inner surface 14 at outer end 10 and at inner end 16. These grooves are used to lock flange assembly 8 to outer end 10 and a first electrical contact element 22 to inner end 16 as will be discussed below.

An oval contact strap opening 23 is formed in tubular body 6 at a chosen location along the body between outer and inner ends 10, 16. Contact strap opening 23 is sized to permit a flexible, second contact strap, which acts as a second terminal 24, to pass through from the interior 26 of tubular body 6 to outside of the tubular body. Second terminal 24 extends from a central groove 28 formed in the outer, circumferentially unbroken cylindrical surface 30 of the second or proximal electrical contact element 32. Element 32 has a smooth cylindrical inner surface 34 and acts as a surface against which a conventional current limiting fuse, not shown, contacts.

Element 32 is preferably made of carbon steel and is tin plated. Carbon steel is used because its coefficient of thermal expansion is closer to that of epoxy/fiberglass tubular body 6 than, for example, stainless steel or copper. Second electrical terminal 24 is tin plated copper and is secured to the base of central groove 28 in outer cylindrical surface 30 of element 32 such as by brazing or using silicon bronze MIG welding. As suggested in FIG. 4, flexible second terminal 24 lies within groove 28 in preparation for contact element 32 being inserted into interior 26 of tubular body 6. When second terminal 24 is axially aligned with contact strap opening 23, contact element 32 is rotated within tubular body 6 until the distal end of second terminal 24 can be directed through contact strap opening 23 to the position of FIGS. 1 and 2.

Contact element 32 includes a pair of O-ring grooves 36 on either side of central groove 28 used to position O-rings 38. O-rings 38 are made of material suitable for use in oil-filled distribution transformers, such as Viton (a fluorelastomer made by DuPont) O-rings from Parker Seal Group of Lexington, Ky. O-rings 38 provide a fluid seal between outer surface 30 of second electrical contact element 32 and inner surface 14 of tubular body 6. Once contact element is in place, adhesive groove 28 is filled, or at least substantially filled, with an adhesive 39, such as an epoxy sold by FEL-PRO, Inc. of Commerce City, Colo. as REST-ECH 162/027 epoxy. This can be accomplished by orienting fuse holder 2 in the position of FIG. 2 and pouring preheated (85° C.) epoxy through opening 23 until groove 28 is full. The epoxy is then allowed to cure for an appropriate length of time, such as 16 hours, at, for example, 85° C.

First electrical contact element 22 includes a cupped-shaped member 40. Cupped-shaped member 40 is preferably made from carbon steel and is tin plated. A first, tin plated copper electrical terminal 42 is secured to an outer face 44 of member 40 such as by brazing or welding. Member 40 also has a cylindrical outer surface 46 with a pair of O-ring grooves 48 which accept a pair of Viton O-rings 50. O-rings 50 provide a good Seal between cupped-shaped member 40 and inner surface 14 of tubular body 6.

Outer surface 46 has a lock ring groove 52 formed therein sized to accept a resilient retaining ring 53. Ring 53 is preferably a stainless steel retaining ring, such as made by Smalley Steel Ring Co. of Wheeling, Ill. as Part No. VHL-262-DV-502. Ring 53 is sized so that it can be radially compressed to permit cupped-shaped member 40 to be inserted into inner end 16 of tubular body 6 and then axially lock cupped-shaped member 40 within inner end 16 of tubular body 6. Once locked in place, it is not possible to remove first electrical contact element 22 from inner end 16 without at least the partial destruction of fuse holder 2.

To keep cupped-shaped member 40 from rotating within tubular body 6, adhesive 39 is used. To apply adhesive 39, tubular body 6 is oriented so that inner (distal) end 16 faces vertically upwardly. The heated adhesive 39 is then slowly poured onto outer face 44, which lies a small distance below the outer end of chamfered edge 18; the heated adhesive 39 also wicks into the small gap 51 formed between that portion of outer cylindrical surface 46 between outer face 44 and the first of the two O-ring grooves 48. Adhesive 39 also acts as an electrical insulator for outer face 44, in addition to adhering member 40 to tubular body 6.

Flange assembly 8 includes a cylindrical body 54 having a radially outwardly extending flange collar 56 extending from the outer cylindrical surface 58 of body 54. Body 54 and flange collar 56 are preferably made of stainless steel due to corrosion considerations. Body 54 includes a portion 60 which is mounted within outer end 10 of tubular body 6. Portion 60 has a lock ring groove 62, a pair of O-ring grooves 64 and an adhesive groove 66 formed in outer surface 58. A second resilient retaining ring 68 is housed within lock ring groove 62. A pair of O-rings 70, also made of Viton elastomer, are housed within O-ring grooves 64. Lock ring 68 and O-rings 70 serve the same locking and sealing functions as the corresponding element at inner end 16. Adhesive groove 66 is filled with adhesive 39 through a hole 73 in body 6 in a manner similar to and at the same time as groove 28 is filled. To help prevent adhesive 39 from escaping past chamfered edge 19, an O-ring 72 is captured between chamfered edge 19 and the base 74 of flange collar 56. O-ring 72 can be made of a variety of materials, such as Buna-N elastomer.

The assembly of fuse holder 2 proceeds generally along the above-described manner. However, it has been found that forming circular grooves 20 in inner surface 14 can be tricky. This is true because the outer surface of tubular body 6 is not necessarily even or concentric with inner surface 14. To ensure circular groove 20 is concentric with inner surface 14, tubular body 6 is chucked or held by engaging inner surface 14 gather than the outer surface of the tubular body. Also, it has been found that it is best to mount second electrical contact element 32 within tubular body 6 prior to forming at least one of circular lock ring grooves 20 to prevent possible damage to O-rings 38 as they pass groove 20.

In use, fuse holder 2 is mounted to the tank 4 of a distribution transformer or other electrical apparatus. A current limiting fuse, not shown, is clamped to the inner end of top closure 12 and inserted into interior 26 of tubular body 6. Top closure 12 is then manipulated to provide a good seal with flange assembly 8 to hermetically seal interior 26 from the environment both within and without tank 4 of the transformer. The fuse can then protect against current overload with appropriate leads connected to first and second terminals 42, 24.

Modification and variation can be made to the disclosed embodiment without departing from the subject of the invention as defined in the following claims. For example, a retaining ring 68 could be used with second electrical contact element 32 if desired to axially lock element 32 in position. The various components could be made from different materials. Terminals 42, 24 could be made in forms other than flexible straps.

What is claimed is:

1. A fuse holder, for use with an electrical apparatus, comprising:

a tubular body having an inner end, an open outer end and an inner surface, the inner surface including a recess towards the outer end;

a first electrical contact element at the inner end of the body;

a second electrical contact element at a chosen location along the body between the inner and outer ends and spaced-apart from the outer end;

a mounting flange assembly at the outer end of the body adapted to sealably mount the tubular body to the electrical apparatus so that at least a substantial portion of the tubular body is within the electrical apparatus; and the mounting flange assembly including a first portion sized to fit within the outer end of the body, the first portion including a non-elastomeric spring lock element adapted to fixedly engage the recess when the first portion is inserted into the outer end so to lock the flange assembly to the body.

2. The fuse holder of claim 1 wherein the inner surface of the body is cylindrical and has a constant diameter, the recess is formed by an inner circular groove in the inner surface and the spring lock element includes a resilient retaining ring adapted to engage the circular groove.

3. The fuse holder of claim 2 wherein the first portion of the flange assembly includes an outer surface opposite said inner surface of the body.

4. The fuse holder of claim 3 wherein the outer surface includes an outer circular groove sized and positioned to accept the retaining ring.

5. The fuse holder of claim 3 further comprising at least one O-ring seal captured between the inner and outer surfaces to create a fluid seal between the outer surface of the flange assembly and the inner surface of the tubular body.

6. The fuse holder of claim 5 further comprising first and second of said O-ring seals.

7. The fuse holder of claim 3 wherein:

the outer surface of the first portion of the flange assembly includes an adhesive groove formed therein; and an adhesive within the adhesive groove adhering the flange assembly to the tubular body.

8. A fuse holder, for use with an electrical apparatus, comprising:

a tubular body having an inner end, an open outer end and a cylindrical inner; surface, the inner surface including an inner circular groove at the inner end of the tubular body;

a first electrical contact element at the inner end of the body, the first electrical contact having an outer cylindrical surface;

the first electrical contact including a non-elastomeric resilient retaining ring extending from the outer cylindrical surface, the retaining ring positioned to engage the inner circular groove thereby securing the first electrical contact to the inner end of the tubular body;

a second electrical contact element at a chosen location along the body between the inner and outer ends and spaced-apart from the outer end; and a mounting flange assembly at the outer end of the body adapted to sealably mount the tubular body to the distribution transformer so that at least a substantial portion of the tubular body is within the distribution transformer.

9. The fuse holder of claim 8 further comprising at least one O-ring positioned between the outer cylindrical surface of the first electrical contact and the inner surface of the tubular body, the O-ring providing a fluid seal between the outer cylindrical surface of the first electrical contact and the inner surface of the tubular body.

10. The fuse holder of claim 9 further comprising first and second of said O-rings.

11. The fuse holder of claim 8 wherein:

the first electrical contact has an outer face;

the outer cylindrical surface of the first electrical contact and the inner surface of the tubular body define an annular clearance gap therebetween; and an adhesive is situated within a portion of the annular clearance gap thereby preventing the first electrical contact from rotating relative to the tubular body.

12. The fuse holder of claim 8 wherein the first electrical contact includes a cup-shaped member made of an electrically conductive metal and an electrical terminal fastened to and extending from the cup-shaped member to a position external of the tubular body.

13. A fuse holder, for use with an electrical apparatus, comprising:

a tubular body having an inner end, an open outer end, an inner surface and a terminal opening at a chosen location along the body between the inner and outer ends, the terminal opening being spaced-apart from the outer end, a portion of the inner surface at the chosen location being cylindrical;

a first electrical contact element at the inner end of the body;

a second electrical contact element at the chosen location;

the second electrical contact element including a circular tubular contact ring having a circumferentially unbroken outer cylindrical surface and a flexible electrical terminal extending from the contact ring and passing through the terminal opening; and a mounting flange assembly at the outer end of the body adapted to sealably mount the tubular body to the electrical apparatus so that at least a substantial portion of the tubular body is within the electrical apparatus.

14. The fuse holder of claim 13 wherein the second electrical contact element includes O-ring seals, the seals located on either side of the electrical terminal.

15. The fuse holder of claim 14 further comprising first and second of said O-ring seals on either side of the electrical terminal.

16. A fuse holder, for use with an electrical apparatus, comprising:

a tubular body having an inner end, an open outer end, a cylindrical inner surface and a terminal opening at a chosen location along the body between the inner and outer ends, the terminal opening being spaced-apart from the outer end, a portion of the inner surface at the chosen location being cylindrical, the inner surface including inner circular grooves at the inner and outer ends of the tubular body;

a first electrical contact element at the inner end of the body, the first electrical contact having an outer cylindrical surface;

the first electrical contact including a non-elastomeric spring lock element, extending from the outer cylindrical surface, adapted to fixedly engage the inner circular groove thereby securing the first electrical contact to the inner end of the tubular body;

a second electrical contact element, at the chosen location, including a circular tubular contact ring having a circumferentially unbroken outer cylindrical surface and a flexible electrical terminal extending from the contact ring and passing through the terminal opening;

a mounting flange assembly at the outer end of the body adapted to sealably mount the tubular body to the electrical apparatus so that at least a substantial portion of the tubular body is within the electrical apparatus; and the mounting flange assembly including a first portion sized to fit within the outer end of the body, the first portion including a non-elastomeric spring lock element adapted to fixedly engage the recesis when the first portion is inserted into the outer end so to lock the flange assembly to the body.

17. A fuse holder, for use with an electrical apparatus, comprising:

A tubular body having an inner end, an open outer end and a cylindrical inner surface, the inner surface including an inner circular groove defining a recess towards the outer end;

a first electrical contact element at the inner end of the body;

a second electrical contact element at a chosen location along the body between the inner and outer ends and spaced-apart from the outer end;

a mounting flange assembly at the outer end of the body adapted to sealably mount the tubular body to the electrical apparatus so that at least a substantial portion of the tubular body is within the electrical apparatus;

the mounting flange assembly including a first portion sized to fit within the outer end of the body, the first portion including an outer surface opposite said inner surface of the body and a resilient retaining ring adapted to fixedly engage the circular groove when the first portion is inserted into the outer end so to lock the flange assembly to the body;

the outer surface of the first portion of the flange assembly including an adhesive groove formed therein;

the body including an access opening fluidly communicating with the adhesive groove; and an adhesive within the adhesive groove adhering the flange assembly to the tubular body.

18. A fuse holder, for use with an electrical apparatus, comprising:

a tubular body having an inner end, an open outer end and a cylindrical inner surface, the inner surface including an inner circular groove at the inner end of the tubular body;

a first electrical contact element at the inner end of the body, the first electrical contact having an outer cylindrical surface and an outer face positioned within the tubular body;

the first electrical contact including a resilient retaining ring extending from the outer cylindrical surface, the retaining ring positioned to engage the inner circular groove thereby securing the first electrical contact to the inner end of the tubular body;

the outer cylindrical surface of the first electrical contact and the inner surface of the tubular body defining an annular clearance gap therebetween;

an electrically insulating adhesive substantially covering the outer face and situated within a portion of the annular clearance gap thereby electrically insulating the outer face and preventing the first electrical contact from rotating relative to the tubular body;

a second electrical contact element at a chosen location along the body between the inner and outer ends and spaced-apart from the outer end; and a mounting flange assembly at the outer end of the body adapted to sealably mount the tubular body to the distribution transformer so that at least a substantial portion of the tubular body is within the distribution transformer.

19. A fuse holder, for use with an electrical apparatus, comprising:

a tubular body having an inner end, an open outer end, an inner surface and a terminal opening a chosen location along the body between the inner and outer ends, the terminal opening being spaced-apart from the outer end, a portion of the inner surface at the chosen location being cylindrical;

a first electrical contact element at the inner end of the body;

a second electrical contact element at the chosen location;

the second electrical contact element including a circular tubular contact ring having a circumferentially unbroken outer cylindrical surface and a flexible electrical terminal extending from the contact ring and passing through the terminal opening;

the second electrical contact element including O-ring seals, the seals located on either side of the electrical terminal;

the outer cylindrical surface and the cylindrical inner surface portion defining a second annular gap situated between the O-ring seals, said second annular gap containing an adhesive adhering the contact ring to the tubular body to secure the contact ring in place at the chosen location; and a mounting flange assembly at the outer end of the body adapted to sealably mount the tubular body to the electrical apparatus so that least a substantial portion of the tubular body is within the electrical apparatus.

* * * * *